US005997346A

United States Patent [19]

Orsley et al.

[11] Patent Number: 5,997,346

[45] Date of Patent: Dec. 7, 1999

[54] INTERSPERSED GROUND RIBBON CABLE ASSEMBLIES AND METHODS THEREFOR

[75] Inventors: Timothy J. Orsley, San Jose; Clifford M. Gold, Fremont, both of Calif.

[73] Assignee: Quantum Corporation, Milpitas, Calif.

[21] Appl. No.: 09/250,977

[22] Filed: Feb. 16, 1999

Related U.S. Application Data

[62] Division of application No. 08/822,885, Mar. 26, 1997, Pat. No. 5,928,028.

[51] Int. Cl.[6] ..... H01R 23/66

[52] U.S. Cl. ..... 439/497

[58] Field of Search ..... 439/395, 404, 439/402, 405, 494, 497, 499

[56] References Cited

U.S. PATENT DOCUMENTS

| | | | |
|---|---|---|---|
| 4,820,175 | 4/1989 | Hasegawa et al. | 439/497 |
| 4,860,447 | 8/1989 | Nicholas et al. | 439/497 X |
| 4,995,828 | 2/1991 | Goodman et al. | 439/405 |
| 5,061,202 | 10/1991 | Nemcovsky | 439/404 |
| 5,076,801 | 12/1991 | Schroll | 439/404 |
| 5,114,355 | 5/1992 | Kimmel et al. | 439/101 |
| 5,224,867 | 7/1993 | Ohtsuki et al. | 439/497 X |
| 5,256,082 | 10/1993 | Yaegashi et al. | 439/497 |
| 5,358,424 | 10/1994 | Bowen et al. | 439/405 |
| 5,902,147 | 5/1999 | Jochen et al. | 439/497 |
| 5,928,028 | 7/1999 | Orsley et al. | 439/497 |

*Primary Examiner*—Khiem Nguyen
*Assistant Examiner*—V. Johnson
*Attorney, Agent, or Firm*—Bryer & Weaver; John C. Chen

[57] ABSTRACT

An insulation displacement connector that includes a plurality of apertures disposed through a mating face and a ribbon-contacting face of the insulation displacement connector. The mating face is configured to mate with a complementary connector complementary in gender to the insulation displacement connector. The ribbon-contacting face is disposed opposite the mating face and configured for coupling with an interspersed ground conductor ribbon cable having a plurality of parallel insulated conductors. The insulation displacement connector includes a plurality of first conductor coupling structures. Each of the first conductor coupling structures is disposed in one of the plurality of apertures and is configured to couple to one of first designated conductors of the plurality of parallel insulated conductors and a contact on the complementary connector when the complementary connector is coupled to the insulation displacement connector at the mating face. The insulation displacement connector farther includes a second conductor coupling structure disposed at the ribbon-contacting face. The second conductor coupling structure is configured to couple with a second designated conductor of the plurality of parallel insulated conductors different from the first designated conductors. The second designated conductor is coupled to ground during use and represents a shielding ground conductor to reduce inductive crosstalk between first selected ones of the first designated conductors.

19 Claims, 5 Drawing Sheets

INTERSPERSED GROUND RIBBON CABLE ASSEMBLIES AND METHODS THEREFOR

REFERENCE TO RELATED APPLICATION

This application is a divisional application of U.S. patent application Ser. No. 08/822,885, filed Mar. 26, 1997 now U.S. Pat. No. 5,928,028.

BACKGROUND OF THE INVENTION

The present invention relates to methods and apparatus for facilitating data communication among computer subsystems. More particularly, the present invention relates to improved insulation displacement connectors that advantageously permit interspersed ground conductor ribbon cables to be employed for data communication among computer subsystems.

The use of ribbon cables and their connectors to facilitate data communication between computer subsystems is well known. To facilitate discussion, FIG. 1 illustrates a ribbon cable assembly 100, including five parallel insulated conductors 112, 114, 116, 118, and 120. Insulated conductors 112–120 are typically employed to carry data, control signals, and the like between subsystem 102 and subsystem 104. Although only five conductors are shown to simplify the illustration, ribbon cable assembly 100 may in practice include any number of parallel conductors required for data transmission.

The conductors of ribbon cable assembly 100 are coupled to female insulation displacement-type connectors (IDC) 122 and 124 at their ends. As shown, female IDC 122 includes five apertures 132, 134, 136, 138, and 140 at its mating face 141. The apertures are configured to mate with respective contacts (e.g., pins) 142, 144, 146, 148, and 150 of a complementary connector 152 disposed on subsystem 102. Since IDC 122 is a female connector, complementary connector 152:, which is complementary in gender, is a male connector. The female IDC is discussed in greater detail in FIGS. 2A–E herein. A similar arrangement exists between female IDC 124 and male connector 162 (disposed on subsystem 104 in FIG. 1). When female IDCs 122 and 124 are coupled to their respective male connectors, each contact (e.g., pin) on male connector 152 of subsystem 102 is in electrical communication, via ribbon cable assembly 100, with its counterpart contact on male connector 162 of subsystem 104 to permit data transfer to take place therebetween.

To facilitate further discussion of the female IDC connector that couples to the conductors of the ribbon cable assembly, FIGS. 2A–E illustrate in detail an exemplary 40-contact female IDC connector 200. Female IDC connector 200 may represent, for example, a female connector for use with the 40-conductor ribbon cable assemblies that are currently popular in coupling hard disks to their hard disk controllers in accordance with the well defined 40-contact ATA (Advanced Technology or "AT" Attachment) specification. Female IDC 200 may represent, for example, a 3417–7000 connector, available from 3M Corp. of St. Paul, Minn.

In FIG. 2A, a schematic- view of the ribbon-contacting side of female IDC 200, i.e., the side at which the conductors terminate, is illustrated. Female IDC 200 includes 40 apertures (labeled A1–A40 in FIG. 2A). A mating side view of female IDC 200, i.e., the side to which a male connector is coupled, is illustrated in FIG. 2B. In FIG. 2B, apertures A1–A40 of FIG. 2A are depicted as seen from the mating side. By conforming the location, dimension, and signal assignment of each aperture to a well-established specification, female IDC 200 may be interchangeably coupled to any male conductor conforming to the same specification.

Within each of apertures A1–A40, there is disposed a conductor coupling structure 202 (shown in greater detail in FIG. 2C), which includes an insulation displacement structure 250 and a contact engaging structure 252. When the ribbon-contacting side of female IDC 200 is placed against a ribbon cable, an insulated conductor of the ribbon cable is disposed between leaves 254(*a*) and 254(*b*) of insulation displacement structure 250. By pressing the ribbon cable to the ribbon-contacting side of female IDC 200, the multiple leaves 254(*a*) and 254(*b*) of conductor coupling structures 202 of the female IDC cut through the insulation surrounding the parallel conductors C1–C40 of the ribbon cable, allowing individual conductor coupling structures 202 to be in direct electrical contact with individual exposed conductors.

Contact engaging structure 252, which may be offset from the plane formed by conductor coupling structure 202, is designed to engage a male connector pin when the pin is inserted into the aperture from the mating side of the female IDC, thereby allowing the pin to be in electrical contact with a conductor of the ribbon cable (which is in direct electrical contact with conductor coupling structure 202 as described earlier). FIG. 2D shows, in one example, the manner in which contact engaging structure 252 of conductor coupling structure 202 engages a pin 256 of the male connector to make an electrical connection therewith.

To further facilitate ease of illustration and comprehension, FIG. 2E is an enlarged schematic view of aperture A1 of FIG. 2A as seen from the ribbon-contacting side, illustrating the general relationship between the aperture, the conductor coupling structure, the conductor, and the pin (which is associated with the male connector and is inserted into the aperture from the mating side). In FIG. 2E, a conductor 182 of the ribbon cable is shown disposed in between leaves 254(*a*) and 254(*b*) of insulation displacement structure 250 of conductor coupling structure 202 (discussed in connection with FIG. 2C earlier). Contact engaging structure 252 of FIG. 2C is also shown within pin receptacle area 260 of the aperture. When a pin (illustrated by the dashed outline) of the male conductor is inserted into pin receptacle area 260, the electrical contact is made between the pin and contact engaging structure 252 at point 262 as shown. As can be appreciated from the foregoing, the coupling of the numerous insulated conductors of a ribbon cable to its female connector can be performed in a single crimping step when insulation displacement-type connectors are employed, thereby saving labor and cost. For this reason, insulation displacement-type connectors are widely used to create ribbon cable assemblies.

For relatively slow ATA data transfer rates, standard ribbon cables (i.e., those having signal-bearing conductors disposed immediately adjacent to one another) work adequately. When the data transfer rates increase, e.g., to facilitate communication between high performance subsystems or during data bursts between even relatively slow subsystems, the inductive cross-talk between adjacent signal-bearing conductors of the ribbon cable degrades the signals thereon. If the inductive cross-talk is excessive, some of the data being transmitted via the ribbon cable assembly may be corrupted. Accordingly, inductive cross-talk limits the data transfer rates between subsystems that are interconnected by a standard ribbon cable.

It is generally known that the use of interspersed ground conductors in a ribbon cable reduces the inductive crosstalk between adjacent signal-bearing conductors. FIG. 3 illustrates an interspersed ground ribbon cable assembly 302, in which the five signal-bearing conductors 304 are shielded from one another by a plurality of ground conductors 306. By shielding the signal-bearing conductors from one another, inductive cross-talk is reduced, thereby permitting data communication to take place it a relatively high rate over interspersed ground ribbon cable assembly 302 and/or increasing the signal-to-noise ratio of the data transmitted over interspersed ground ribbon cable assembly 302.

It is a relatively simple matter to increase the number of conductors in a given ribbon cable such that every other conductor is non signal-bearing and grounded, thereby creating an interspersed ground ribbon cable. However, the coupling of conductors of the resultant interspersed ground ribbon cable with its female IDCs (e.g., female IDCs 122 and 124) has, up to now, presented manufacturers with many difficulties. This is because, as mentioned earlier, the number, location, dimension, and signal assignment of each aperture in the female IDC typically conform to already-established specification and preferably remain unchanged for compatibility reasons even as shielding ground conductors are added. In other words, the interspersed ground conductors of the interspersed ground ribbon cable, e.g., ground conductors 306 in FIG. 3, are preferably coupled to ground without requiring changes to the female IDC, at least as far as the mating side of the female IDC is concerned.

In the prior art, the fabrication of an interspersed ground ribbon cable assembly typically involves a significant amount of manual labor. In one case, after the female IDCs are pressed onto their signal bearing conductors, the remaining interspersed ground conductors are stripped off their insulation and then manually soldered together. The interconnected ground conductors are then coupled to ground, e.g., via the grounded chassis of the computer system. As can be appreciated from the foregoing, the labor intensive nature of the prior art technique defeats the very purpose of using insulation displacement connectors, i.e., to simplify fabrication and reduce manufacturing cost. Because of the additional manual labor required, interspersed ground ribbon cable assemblies manufactured in accordance with the prior art techniques tend to be costly.

In view of the foregoing, there are desired improved insulation displacement-type connector designs that simplify the coupling with interspersed ground conductor ribbon cables. Further, the improved insulation-displacement type connectors preferably require no changes to the existing complementary connector to which it is coupled in order to facilitate backward compatibility with existing subsystems.

SUMMARY OF THE INVENTION

The invention relates, in one embodiment, to an insulation displacement connector that includes a plurality of apertures disposed through a mating face and a ribbon-contacting face of the insulation displacement connector. The mating face is configured to mate with a complementary connector complementary in gender to the insulation displacement connector. The ribbon-contacting face is disposed opposite the mating face and configured for coupling with an interspersed ground conductor ribbon cable having; a plurality of parallel insulated conductors.

The insulation displacement connector includes a plurality of first conductor coupling structures. Each of the first conductor coupling structures is disposed in one of the plurality of apertures and is configured to couple to one of first designated conductors of the plurality of parallel insulated conductors and a contact on the complementary connector when the complementary connector is coupled to the insulation displacement connector at the mating face. The insulation displacement connector further includes a second conductor coupling structure disposed at the ribbon-contacting face. The second conductor coupling structure is configured to couple with a second designated conductor of the plurality of parallel insulated conductors different from the first designated conductors. The second designated conductor is coupled to ground during use and represents a shielding ground conductor to reduce inductive crosstalk between first selected ones of the first designated conductors.

In another embodiment, the invention relates to a method for forming an interspersed ground conductor ribbon cable assembly for facilitating communication between computer subsystems. The method includes providing a ribbon cable including a plurality of parallel insulated conductors. The method further includes coupling first designated conductors of the ribbon cable with first conductor coupling structures disposed in apertures of an insulation displacement connector.

The method further includes coupling second designated conductors of the ribbon cable different from the first designated conductors with a ground conducting bar disposed on a ribbon-contacting face of the insulation displacement conductor. The second designated conductors represent shielding ground configured to reduce inductive crosstalk among the first designated conductors in use. The ribbon-contacting face is configured for contacting the ribbon cable. The ground conducting bar is configured to be coupled to a ground potential when the ribbon cable is crimped onto the insulation displacement connector.

These and other advantages of the present invention will become apparent upon reading the following detailed descriptions and studying the various figures of the drawings.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

In accordance with one embodiment of the present invention, there is provided an inventive insulation displacement connector that advantageously simplifies the fabrication of an interspersed ground conductor ribbon cable assembly. The inventive insulation displacement connector, while accommodating the additional interspersed ground conductors, advantageously conforms to existing specifications at its mating face, i.e., the connector face configured for coupling to another connector, thereby maintaining backward compatibility.

By maintaining substantially unchanged the configuration of the mating face of the connector, the inventive insulation displacement connector allows an interspersed ground conductor ribbon cable to be employed for data transmission even if the connector specification was originally designed to accommodate ribbon cables having no interspersed ground conductors (as for example in the case of the current 40-contact ATA specification). Advantageously, data transmission between subsystems may take place at higher transmission rates and/or with improved signal-to-noise margins even if those subsystems are originally provided with connectors whose specifications may not provide for interspersed ground conductors in the ribbon cable.

Furthermore, the inventive insulation displacement connector advantageously facilitates the efficient coupling of the interspersed ground conductors to ground, thereby reducing assembly costs. In one embodiment, the interspersed ground conductors of the interspersed ground conductor ribbon cable are coupled to ground, when mated, in the same crimping step that is employed in the prior art to couple the signal-bearing conductors to the prior art insulation displacement connector. Since no additional manual labor and/or manufacturing step is required to fabricate the inventive interspersed ground conductor ribbon cable assembly, substantial savings in assembly costs are realized, and a lower cost interspersed ground conductor ribbon cable assembly is achieved thereby.

Figure 4:
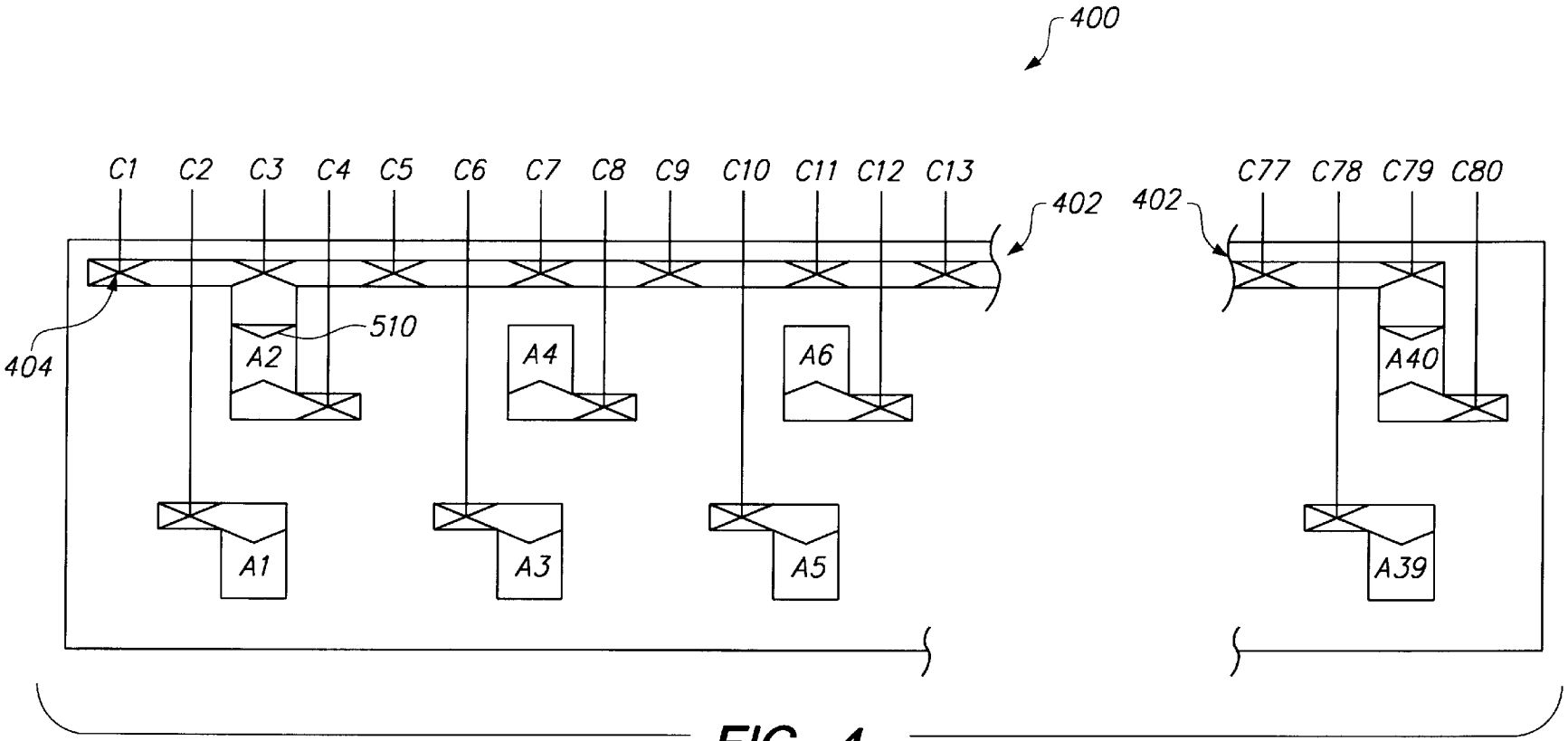
FIG. 4 depicts, in accordance with one embodiment of the present invention, an improved insulation displacement connector.

To facilitate discussion of the foregoing, FIG. 4 depicts, in accordance with one embodiment of the present invention, an insulation displacement connector 400 as seen from its ribbon-contacting face, i.e., the connector face configured to couple to the insulated conductors of the interspersed ground conductor ribbon cable. For ease of understanding, insulation displacement connector 400 represents a connector whose mating face conforms to the aforementioned 40-contact ATA specification. As discussed earlier, the ATA specification was originally designed for data transmission via the 40 signal-bearing contacts of its connectors. However, insulation displacement connector 400 can accommodate, at its ribbon-mating face, up to 80 conductors. Accordingly, every other conductor in the ribbon cable may be employed as a shielding ground conductor. In the example of FIG. 4, the signal-bearing conductors are referenced by even conductor numbers (e.g., C2, C4, C6, and the like). The shielding ground conductors, which are interspersed among the signal-bearing conductors, are referenced by odd conductor numbers (e.g., C1, C3, C5, and the like).

As such, the inventive insulation displacement connector advantageously facilitates improved communication between subsystems whose connectors may have fewer contacts than the total number of signal-bearing conductors and shielding ground conductors in the dispersed ground ribbon cable. To put it differently, the inventive insulation displacement connector is capable of accommodating, at its ribbon-contacting face, any additional number of shielding ground conductors while keeping the number of contacts at its mating face substantially unchanged to maintain backward compatibility.

In one embodiment, the 80-conductor ribbon cable employ 25-mil conductors wherein 50-mil conductors were employed in the original 40-conductor cable. Accordingly, the width of the interspersed ground conductor ribbon cable does not vary greatly when the interspersed ground conductors are added. It should be borne in mind that although the use of an 80-pin ribbon cable is discussed hereinafter to facilitate ease of comprehension, the disclosed insulation displacement connector may be modified to provide shielding ground conductors for any existing ribbon cable assembly irrespective of the number of signal-bearing conductors involved. Further, although the ATA specification is employed herein to facilitate consistency in the discussion, the disclosed insulation displacement connector may be employed to improve data transmission in any ribbon cable, irrespective whether the ATA specification is employed. Still further, although the embodiment discussed provides a shielding ground conductor in between any two adjacent signal-bearing conductors, such is not a requirement. For example, certain groups of signals may be less susceptible (relative to other signals in the ribbon cable) to inductive crosstalk. Accordingly, an interspersed ribbon-conductor assembly may be formed wherein only some groups of signal-bearing conductors employ interspersed shielding ground conductors.

In FIG. 4, there are shown a plurality of apertures A1–A40. In accordance with the existing 40-contact ATA specification, apertures A1–A40 form two rows. For ease of reference, these rows include an odd row and an even row. In substantially all respects pertaining to apertures A1–A40, connector 400 conforms to the existing and well defined ATA specification to facilitate backward compatibility with male connectors conforming to the same specification.

Figure 1:
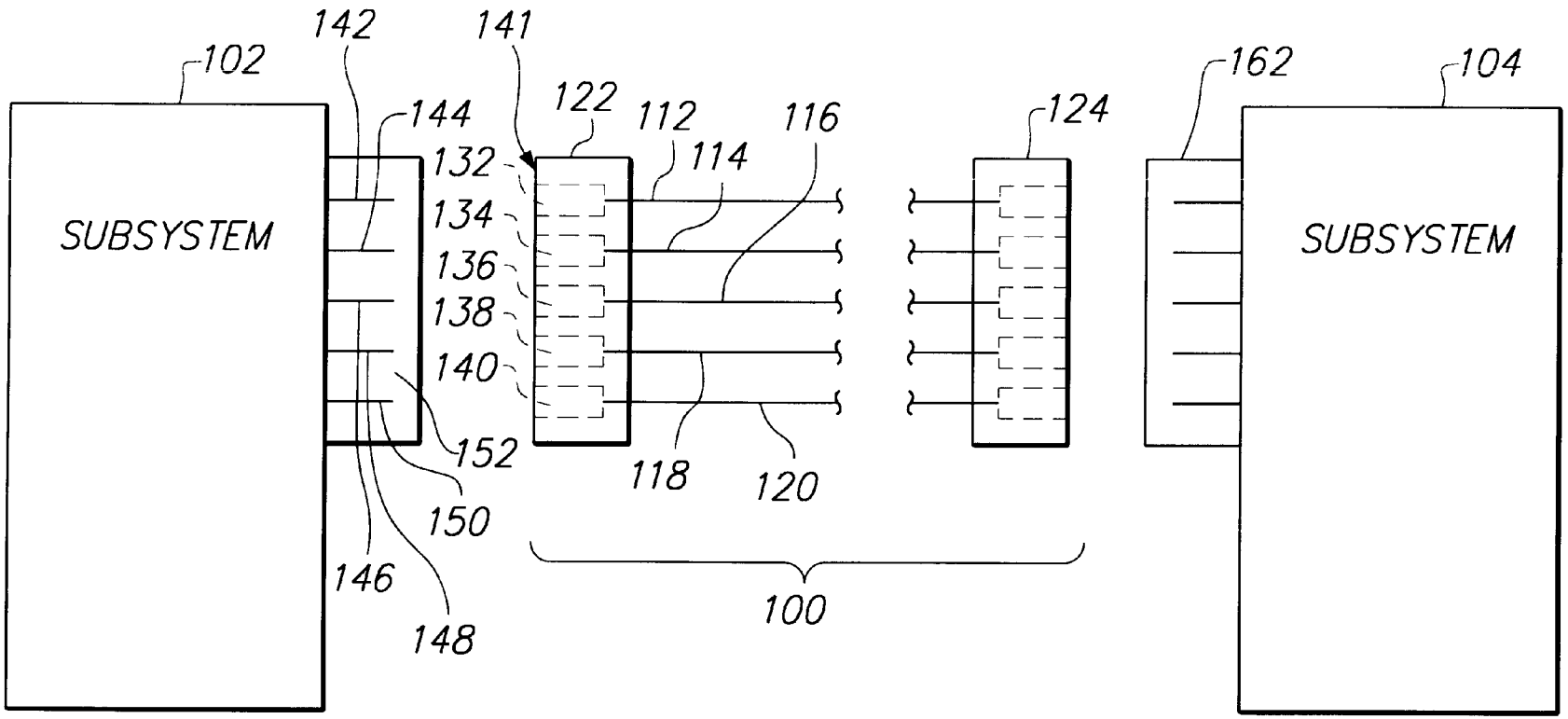
FIG. 1 illustrates a prior art ribbon cable assembly, including five parallel signal-bearing insulated conductors.
Figure 2A:
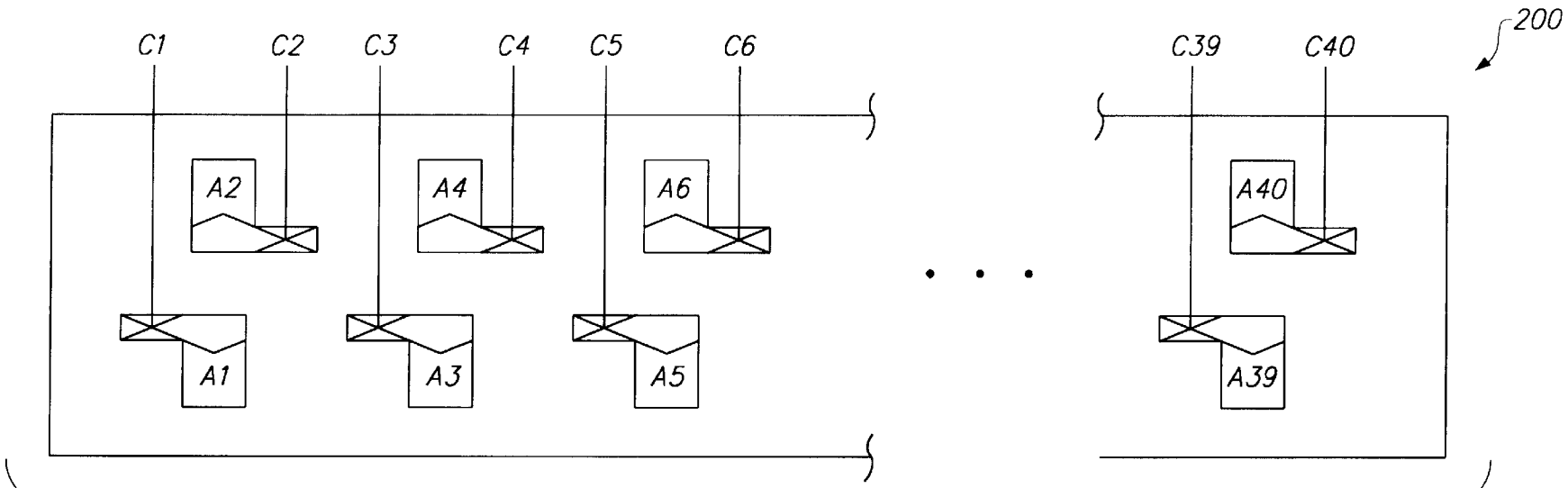
FIG. 2A illustrates a prior art insulation displacement connector as seen from the ribbon-contacting side.
Figure 2B:
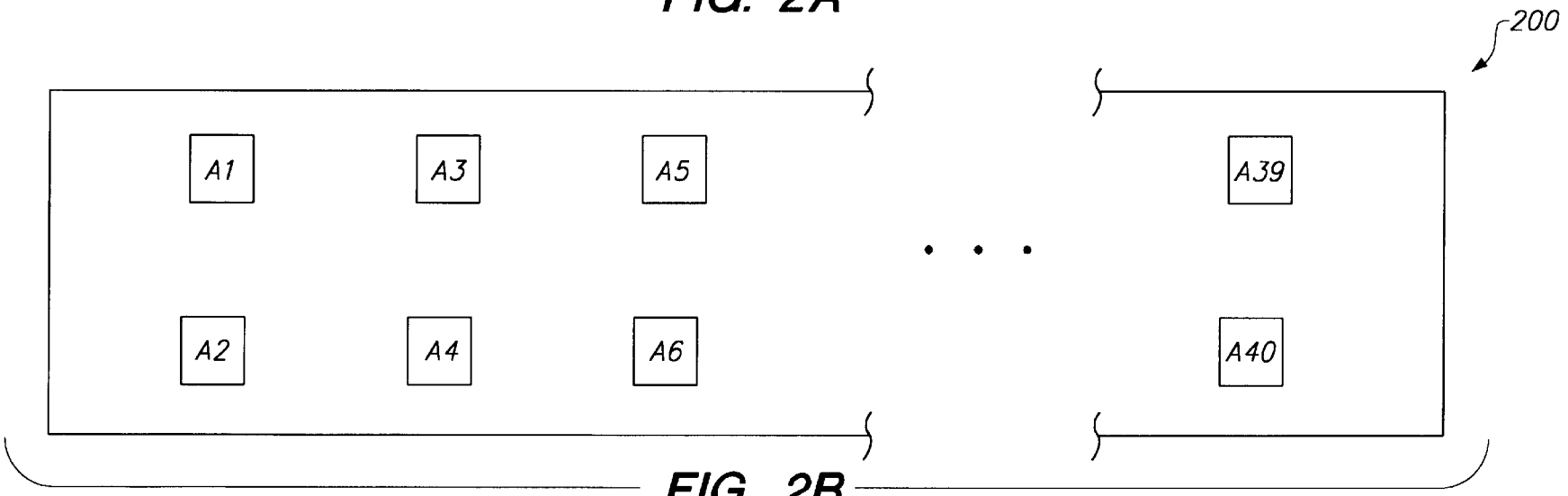
FIG. 2B illustrates the insulation displacement connector of FIG. 2A as seen from its mating side.
Figure 2D:
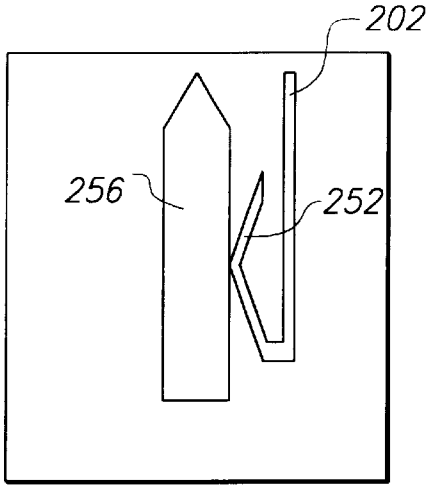
FIG. 2D illustrates the relationship between a contact engaging structure of the conductor coupling structure of FIG. 2C and the contact to which it is electrically coupled.
Figure 2C:
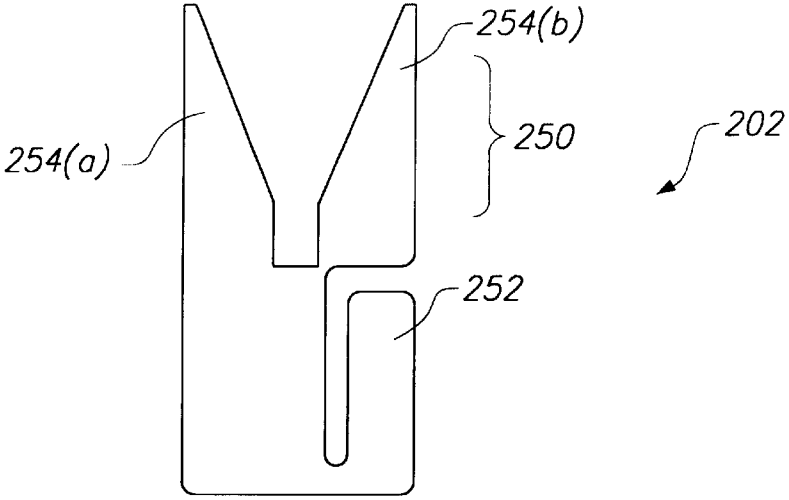
FIG. 2C illustrates in greater detail a conductor coupling structure of the insulation displacement connector of FIG. 2A.
Figure 3:
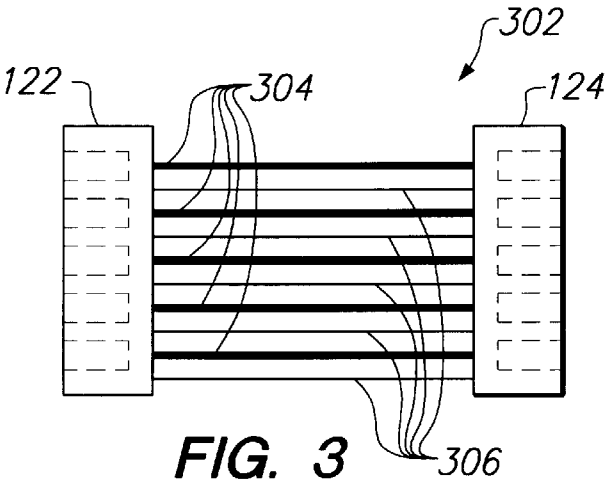
FIG. 3 illustrates an interspersed ground ribbon cable assembly, in which the signal-bearing conductors are shielded from one another by a plurality of interspersed ground conductors.
Figure 2E:
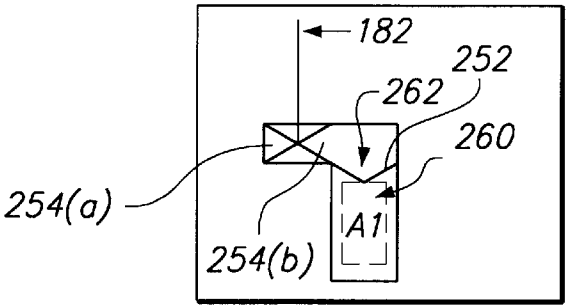
FIG. 2E illustrates in greater detail a schematic view of an aperture of the insulation displacement connector of FIG. 2A, including the conductor coupling structure, the contact engaging structure, and the pin disposed therein.

Within each aperture, there is disposed a conductor coupling structure substantially similar to conductor coupling structure 202 of FIG. 2C. As discussed earlier in connection with FIG. 2C, each conductor coupling structure includes an insulation displacement structure to facilitate the formation of an electrical contact with a conductor of the ribbon cable, and a contact engaging structure to facilitate the formation of an electrical contact with a pin of the male connector when insulation displacement connector 400 is coupled to the male connector at its mating face.

The conductor coupling structures within apertures A1–A40 preferably couple with signal-bearing conductors, e.g., the even-numbered conductors in the example of FIG. 4. Compared to prior art connector 200 of FIG. 2B, there is essentially no difference on the mating side of connector 400. In fact, the mating side of connector 400 appears substantially the same to a male ATA connector (e.g., with respect to the location, dimension, and signal assignment of each aperture of connector 400) as the mating side of prior art connector 202, which is illustrated in FIG. 2B.

With regard to the interspersed insulating ground conductors, i.e., the additional shielding ground conductors shown in FIG. 4 as the odd-numbered conductors, a novel mechanism is provided at the ribbon-contacting face of connector 400 to couple with and ground these interspersed insulating ground conductors. In one embodiment, there is provided a ground conducting bar 402, which is electrically coupled to a plurality of conductor coupling structures 404. Conductor coupling structures 404 are configured to pierce and form electrical contact only with the insulating ground conductors when the interspersed ground conductor ribbon cable is pressed against insulation displacement connector 400 at its ribbon-contacting face. In the example of FIG. 4, conductor coupling structures 404 electrically couple with odd-numbered conductors C1, C3, C5, and the like. As such, the odd-numbered conductors are electrically coupled to one another via ground conducting bar 402. When any of conductor coupling structures 404 is coupled to a ground potential (as is the case in use), all odd-numbered conductors are pulled to ground as well, thereby providing shield ground for adjacent even-numbered signal-bearing conductors.

Figure 5:
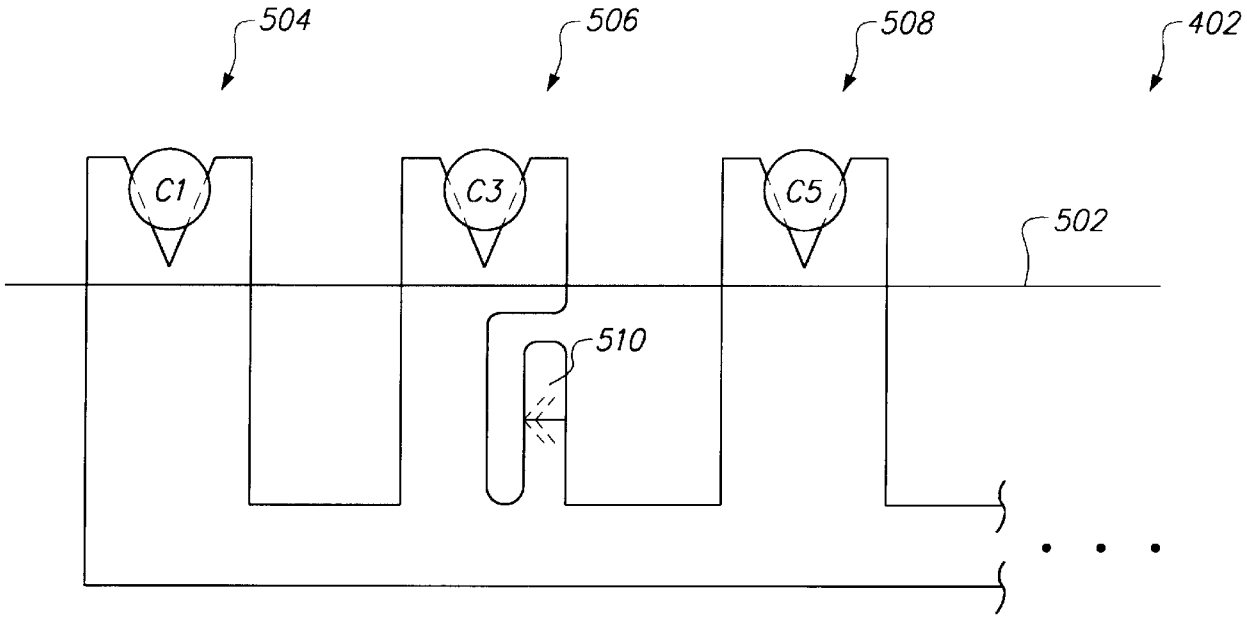
FIG. 5 illustrates, in accordance with one embodiment of the present invention, an exemplary ground conducting bar, which is disposed on the ribbon-contacting face of the improved insulation displacement connector of FIG. 4.

FIG. 5 illustrates an exemplary ground conducting bar 402 of FIG. 4, which includes a plurality of interconnected conductor coupling structures of which conductor coupling structures 504, 506, and 508 are shown. Portions of the conductor coupling structures above line 502 represent portions protruding out of the ribbon-contacting face of the connector. In the present example, the odd-numbered conductors of the interspersed ground conductor ribbon cable are designated the shielding ground conductors. Accordingly, the conductor coupling structures of ground conducting bar 402 are arranged to form electrical contact with the designated insulating ground conductors, e.g., odd-numbered conductors C1, C3, and C5. Of course ground conducting bar 402 may be modified as necessary to couple with shielding ground conductors of any ribbon cable, irrespective of their numbers and/or locations.

In the example of FIG. 5, the plurality of interconnected conductor coupling structures are formed (by stamping for example) from a single metal strip, e.g., copper or one of its alloys, and left interconnected at the bottom portion of the ground conducting bar to electrically interconnect, the conductor coupling structures together. However, other conventional techniques for interconnecting the conductor coupling structures that couple to the insulating ground conductors of the interspersed ground conductor ribbon cable may be employed as well.

Having shown one embodiment of ground conducting bar 402 in detail, the remaining structures of connector 400 of FIG. 4 will now be discussed. Referring back now to FIG. 4, ground conducting bar 402 is preferably disposed parallel to a row of apertures, e.g., the even-numbered aperture row in the example of FIG. 4. As explained hereinbelow, the aperture row which lies adjacent to ground conducting bar 402 preferably includes at least one aperture that carries the ground potential to simplify the coupling of ground conductor bar 402 to ground.

In the case of the 40-contact ATA specification, apertures A2, A22, A24, A26, A30, and A40 of the even-numbered aperture row, along with aperture A19 of the odd-numbered aperture row, carry the ground potential in use. Since a ground-carrying aperture exists in both the odd-numbered and the even-numbed aperture rows, ground conductor bar 402 may be disposed adjacent to either row, or even in between the rows. On ground conductor bar 402, a conductor coupling structure that is adjacent to an aperture carrying the ground potential is preferably provided with contact engaging structure (substantially similar to contact engaging structure 252 of FIGS. 2C and 2D). The contact engaging structure preferably protrudes into the pin-receptacle area of the adjacent ground-carrying aperture. This contact engaging structure then comes into electrical contact the ground pin of the male connector when the ground pin is inserted into the pin-receptacle area of the ground-carrying aperture, thereby grounding bar 402 (and the shielding ground conductors coupled to it) during use.

Figure 6:
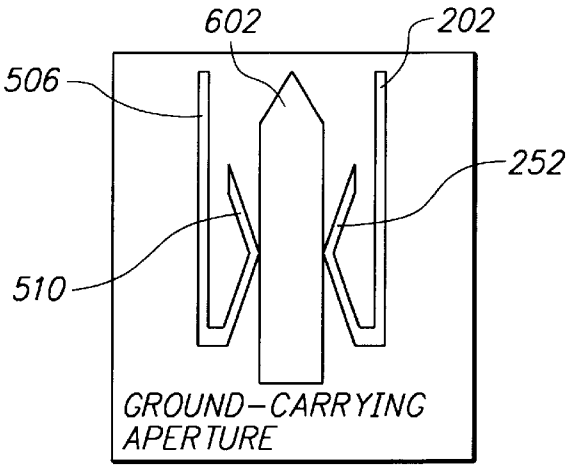
FIG. 6 illustrates the manner in which the ground conducting bar is coupled to a ground potential in use, in accordance with one embodiment of the present invention.

One such ground pickup contact engaging structure is shown by reference numeral 510 in FIGS. 4 and 5. Since aperture A2 of the ATA specification carries the ground potential, the presence of a pin within the pin receptacle area of aperture A2 electrically couples contact-engaging structure 510 of conductor coupling structure 506 to ground. The relationship between a ground pin 602, contact engaging structure 510 of conductor coupling structure 506, and contact engaging structure 252 of conductor coupling structure 202 (of the ATA ground) for ground-carrying aperture A2 is shown in FIG. 6. In FIG. 6, the ribbon-contacting face is disposed toward the top of the figure, and the mating face (into which pin 602 of the male connector is inserted) is disposed toward the bottom of the figure. When conductor coupling structure 506 is coupled to ground, the entire ground conducting bar 402, as well as the shielding odd-numbered ground conductors of the ribbon cable, are also coupled to ground. Advantageously, the provision of contact engaging structures with selected conductor coupling structures of the ground conducting bar simplifies the pick up of the ground potential from the ATA ground, in turn simplifying the coupling of the ground conducting bar with the ground potential.

In general, a single ground pickup point is sufficient to pull ground conducting bar 402 to the ground potential. As mentioned earlier, when ground conducting bar 402 is at the ground potential during use, a shielding ground potential is provided in the shielding ground conductors of the interspersed ground conductor cable to reduce inductive crosstalk among the adjacent signal-bearing conductors. If desired, additional ground pickup points may be provided using other conductor coupling structures of ground conducting bar 402, i.e., those disposed adjacent to the other ground-carrying apertures such as apertures A22, A24, A26, A30, and A40 of the 40-contact ATA interface.

In the example of FIG. 4, no contact engaging structure associated with ground conducting bar 402 is provided for ground-carrying aperture A19 since this odd-numbered aperture does not lie proximate to ground conducting bar 402. In another embodiment, if ground conducting bar 402 is disposed next to the odd-numbered aperture row, the ground potential in ground-carrying aperture A19 may be picked up through the use of a contact engaging structure associated with ground conducting bar 402.

In yet another embodiment, if ground conducting bar 402 is disposed in between the odd-numbered aperture row and the even-numbered aperture row, contact engaging structures associated with ground conducting bar 402 may be provided to pick up the ground potential from one or both of the rows. In still another embodiment, an external grounding strap may be provided with ground conducting bar 402, as an alternative to or in addition to the ground pickup contact engaging structures, to allow ground conducting bar 402 to be grounded to other ground points during use (e.g., on the chassis).

It should be noted that since ground conducting bar 402 is disposed only on the ribbon-contacting face of the inventive insulation displacement connector, there is a great deal of flexibility with regard to the arrangement of ground conducting bar 402. In general, as long as the mating face of insulation displacement connector conforms to the required specification, ground conductor bar 402 may be arranged in any desired manner at the ribbon-contacting face of insulation displacement connector 400 to couple to the insulating ground conductors.

As can be appreciated from the foregoing, the inventive insulation displacement connector advantageously reduces assembly cost since the additional interspersed ground conductors of the ribbon cable can be tied to ground in the same crimping step that is employed to couple the signal-bearing conductors to their respective conductor coupling structures in the female insulation displacement connector. Backward compatibility with existing connector interfaces is advantageously maintained while permitting interspersed ground conductors to be employed in the ribbon cable that couple between subsystems. Advantageously, communication between subsystems can take place at higher data transmission rates and/or improved margins (signal-to-noise or timing).

While this invention has been described in terms of several preferred embodiments, there are alterations, permutations, and equivalents which fall within the scope of this invention. For example, although the disclosed embodiment is a female insulation displacement connector, the inventive ground conducting bar may be provided at the ribbon-contacting face of a male insulation displacement connector to permit the resulting interspersed ground conductor ribbon cable assembly to couple to existing female connectors on the computer subsystems.

By way of example, when the inventive ground conducting bar is employed with male insulation displacement connectors, the conductor coupling structure disposed in the aperture of the connector may be substituted with a conductor coupling structure having an insulation displacement structure on one end and a pin on the other end. The pins serve as contact engaging structure to facilitate coupling with contacts within apertures provided in a connector that is complementary in gender, e.g., a female connector in this case. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. An insulation displacement connector, comprising:

a plurality of apertures disposed through a mating face and a ribbon-contacting face of said insulation displacement connector, said mating face being configured to mate with a complementary connector complementary in gender to said insulation displacement connector, said ribbon-contacting face being disposed opposite said mating face and configured for coupling with an interspersed ground conductor ribbon cable having a plurality of parallel insulated conductors;

a plurality of first conductor coupling structures, each of said first conductor coupling structures being disposed in one of said plurality of apertures, each of said first conductor coupling structures including, an insulation displacement structure protruding out of said ribbon-contacting face, said insulation displacement structure being configured to pierce an insulating cover of one of first designated ones of said parallel insulated conductors to permit said each of said first conductor coupling structures to form an electrical contact with said one of first designated ones of said parallel insulated conductors when said interspersed ground conductor ribbon cable is pressed against said insulation displacement connector at said ribbon-contacting face;

a contact engaging structure, said contact engaging structure being electrically coupled to said insulation displacement structure and configured to electrically couple with a contact of said complementary connector when said complementary connector is mated with said insulation displacement connector at said mating face; and a plurality of interconnected second conductor coupling structures disposed at said ribbon-contacting face, each of said interconnected second conductor coupling structures including an insulation displacement structure disposed at said ribbon-contacting face, said insulation displacement structures of said plurality of interconnected second conductor coupling structures being configured to pierce insulating covers of second designated ones of said parallel insulated conductors to permit said plurality of interconnected second conductor coupling structures to form electrical contact with said second designated ones of said parallel insulated conductors, said second designated ones of said parallel insulated conductors being different from said first designated ones of said parallel insulated conductors, wherein at least one of said plurality of interconnected second conductor coupling structures having a contact engaging structure configured to electrically couple with a given contact of said complementary connector when said complementary connector is mated with said insulation displacement connector at said mating face, said given contact representing a ground contact in use, thereby electrically grounding said plurality of interconnected second conductor coupling structures and said second designated ones of said parallel insulated conductors during use.

2. The insulation displacement connector of claim 1 wherein said plurality of interconnected second conductor coupling structures are formed from a single metal strip.

3. The insulation displacement connector of claim 1 wherein said complementary connector conforms to a specification that provides for fewer contacts than a total number of conductors in said plurality of parallel insulated conductors.

4. The insulation displacement connector of claim 3 wherein said complementary connector conforms to a 40-contact ATA specification for coupling between subsystems.

5. The insulation displacement connector of claim 4 wherein said insulation displacement connector represents a female connector, said complementary connector represents a male connector, and said contact on said complementary connector represents a pin.

6. The insulation displacement connector of claim 4 wherein said insulation displacement connector represents a male connector and said complementary connector represents a female connector.

7. The insulation displacement connector of claim 4 wherein one of said subsystems represents a hard disk drive.

8. The insulation displacement connector of claim 1 wherein said plurality of interconnected second conductor coupling structures is disposed in parallel to said plurality of apertures, said contact engaging structure of said at least one of said plurality of interconnected second conductor coupling structures protruding into one of said plurality of apertures to electrically couple with said give contact.

9. The insulation displacement connector of claim 1 wherein alternate conductors of said plurality of parallel insulated conductors are grounded during use.

10. An insulation displacement connector, comprising:

a plurality of apertures disposed through a mating face and a ribbon-contacting face of said insulation displacement connector, said mating face being configured to mate with a complementary connector complementary in gender to said insulation displacement connector, said ribbon-contacting face being disposed opposite said mating face and configured for coupling with an interspersed ground conductor ribbon cable having a plurality of parallel insulated conductors; and a plurality of first conductor coupling structures, each of said first conductor coupling structures being disposed in one of said plurality of apertures and configured to couple to one of first designated conductors of said plurality of parallel insulated conductors and a contact on said complementary connector when said complementary connector is coupled to said insulation displacement connector at said mating face; and a second conductor coupling structure disposed at said ribbon-contacting face, said second conductor coupling structure being configured to couple with a second designated conductor of said plurality of parallel insulated conductors different from said first designated conductors, said second designated conductor being coupled to ground during use and representing a shielding ground conductor to reduce inductive crosstalk between first selected ones of said first designated conductors.

11. The insulation displacement connector of claim 10 wherein said complementary connector conforms to a specification that provides for fewer contacts than a total number of conductors in said plurality of parallel insulated conductors.

12. The insulation displacement connector of claim 11 further comprising a third conductor coupling structure disposed at said ribbon-contacting face, said third conductor coupling structure being electrically coupled to said second conductor coupling structure and configured to couple with a third designated conductor of said plurality of parallel insulated conductors different from said first designated conductors, said third designated conductor being coupled to ground during use and representing another shielding ground conductor to reduce inductive crosstalk between second selected ones of said first designated conductors.

13. The insulation displacement connector of claim 12 wherein said complementary connector conforms to a 40-contact ATA specification for coupling between subsystems.

14. The insulation displacement connector of claim 13 wherein said insulation displacement connector represents a female connector, said complementary connector represents a male connector, and said contact on said complementary connector represents a pin.

15. The insulation displacement connector of claim 13 wherein said insulation displacement connector represents a male connector and said complementary connector represents a female connector.

16. The insulation displacement connector of claim 13 wherein one of said subsystems represents a hard disk drive.

17. The insulation displacement connector of claim 13 wherein said interspersed ground conductor ribbon cable represents an 80-conductor ribbon cable, alternate conductors of said 80-conductor ribbon cable being configured to provide shielding ground for signal-bearing conductors of said 80-conductor ribbon cable.

18. The insulation displacement connector of claim 10 wherein said third conductor coupling structure and said second conductor coupling structure are formed from a single metal strip.

19. The insulation displacement connector of claim 10 wherein said second conductor coupling structure includes a contact engaging structure electrically coupled with said insulation displacement connector, said contact engaging structure protrudes into one of said plurality of apertures to electrically couple to a ground contact of said complementary connector when said ground contact of said complementary connector is coupled to said insulation displacement connector at said mating face.

* * * * *